US006333723B1

(12) United States Patent
Locke

(10) Patent No.: US 6,333,723 B1
(45) Date of Patent: Dec. 25, 2001

(54) SWITCHABLE TRANSCEIVER ANTENNA

(75) Inventor: Evan Locke, Porters Lake (CA)

(73) Assignee: Magneto-Inductive Systems Limited (CA)

( * ) Notice: Subject to any disclaimer, the term of this patent is extended or adjusted under 35 U.S.C. 154(b) by 0 days.

(21) Appl. No.: 09/729,275

(22) Filed: Dec. 5, 2000

(51) Int. Cl.[7] ..... H01Q 1/36
(52) U.S. Cl. ..... 343/895; 343/850; 343/876
(58) Field of Search ..... 343/895, 876, 343/866, 850, 858, 741; 340/870.31, 572; H01Q 1/36

(56) References Cited

U.S. PATENT DOCUMENTS

| | | | | |
|---|---|---|---|---|
| 5,250,944 | | 10/1993 | Urbas et al. | 340/870.31 |
| 5,428,363 | | 6/1995 | D'Hont | 343/742 |
| 5,515,285 | * | 5/1996 | Garrett, Sr. et al. | 364/460 |
| 5,608,417 | | 3/1997 | de Vall | 343/895 |
| 5,650,778 | | 7/1997 | Urbas et al. | 340/870.31 |
| 5,686,927 | | 11/1997 | Simmons | 343/702 |
| 5,786,763 | * | 7/1998 | Canipe | 340/572 |
| 6,059,718 | * | 5/2000 | Taniguchi et al. | 600/117 |

* cited by examiner

*Primary Examiner*—Hoanganh Le
(74) *Attorney, Agent, or Firm*—Dinesh Agarwal, P.C.

(57) ABSTRACT

An antenna for a transceiver. The antenna is switchable between a receive and a transmit mode. In receive mode, the antenna is configured to provide increased sensitivity for improved inductive pickup of signals. In transmit mode, the antenna is configured to provide efficient power output without undue losses. The antenna coil comprises a plurality of conductor bundles. In receive mode, the conductor bundles in series to increase the number of effective turns in the antenna coil and thereby increase the inductive pickup of the coil for receiving signals. In transmit mode, the conductor bundles are configured in parallel. The parallel configuration of the conductor bundles reduces the AC and DC resistance of the antenna coil, and therefore the power loss, to allow the antenna to be driven efficiently to transmit signals.

12 Claims, 3 Drawing Sheets

SWITCHABLE TRANSCEIVER ANTENNA

FIELD OF THE INVENTION

The present relates to transceivers, and more particularly to a transceiver having an antenna switchable between a receive mode and a transmit mode.

BACKGROUND OF THE INVENTION

Transceivers comprise a radio transmitter and a radio receiver combined in a single unit with a switch to permit both transmission and reception of signals. In designing a transceiver, it is highly desirable to utilize a single antenna for sending and receiving. However, using the same antenna for transmitting and receiving presents a number of problems.

The principle problem for a single antenna design is the trade-off between sufficient sensitivity for receiving signals and maintaining manageable voltage levels and losses for transmitting. In order to provide sufficient sensitivity for receiving signals, it is desirable to increase the number of turns (wire) in the antenna. While increasing the number of turns improves the sensitivity for reception, higher voltage levels are required to drive the additional turns when the antenna is used for the transmission of signals. There are also the associated electrical losses in the turns of the coil for the antenna. Since most transceivers are battery powered, power needs and losses are an important design consideration.

Accordingly, there remains a need for antenna configuration suitable for a transceiver which overcomes these problems.

BRIEF SUMMARY OF THE INVENTION

The present invention provides an antenna for a transceiver which is switchable between a receive and a transmit mode. In receive mode, the antenna is configured to provide increased sensitivity for improved inductive pickup of signals that are transmitted via either magnetic fields or electromagnetic waves, such as radio signals. In transmit mode, the antenna is configured to provide efficient power output without undue losses.

According to one aspect of the invention, the antenna is arranged using Litz-type wire. Litz wire comprises a plurality of bunched strands of fine wire. In transmit mode, all of the bunched strands are switched into a parallel configuration. In receive mode, all of the bunched strands are switched into a series configuration. In transmit mode, the parallel configuration has the effect of reducing proximity effect and power losses, thereby increasing battery life for the transceiver. In receive mode, the series configuration of the bunched wire strands effectively increases the number of turns which in turn improves the sensitivity of the transceiver by allowing more inductive pickup of signal.

In a first aspect, the present invention provides an antenna coil for a transceiver having a receiver module for receiving signals and a transmitter module for transmitting signals, the antenna coil comprises: (a) a plurality of conductors, each of the conductors having a first end and a second end; (b) a switch mechanism for coupling the conductors in parallel for operation in transmit mode, and the switch including an input port for connecting the first ends of the conductors to a first output terminal on the transmit module and second input port for connecting the second ends of the conductors to a second output terminal on the transmit module, the first and second output terminals forming an output port for the transmit module; (c) a switch mechanism for coupling the conductors in series for operation in receive mode, and the switch including a first port for connecting the first end of one of the conductors to a first input terminal on the receive module and a second port for connecting the second end of another of the conductors to a second input terminal on the receive module, the first and second input terminals forming an input port for the receive module; (d) a control mechanism for switching the switch mechanism between the receive mode and transmit mode of operation.

In a second aspect, the present invention provides an antenna coil for a transceiver, the transceiver being operable in a receive mode and a transmit mode, and the transceiver includes a receiver module for receiving signals in the receive mode and a transmitter module for transmitting signals in the transmit mode, the antenna coil comprises. (a) at least two conductors, each of the conductors having a first end and a second end; (b) a switching module having at least two first switch inputs, at least two second switch inputs, each of the first switch inputs being coupled to one of the first ends of each of the conductors, and each of the second switch inputs being coupled to one of the second ends of each of the conductors; (c) the switching module including at least two receive switch output ports and at least two receive switch input ports, and the switching module including at least two transmit switch input ports and at least two transmit switch output ports; (d) in the receive mode of operation, the first receive switch output is coupled to a first input terminal in the receiver module and the second receive switch output is coupled to a second input terminal in the receiver module, the second receive switch output port is coupled to the first receive switch input port, so that the conductors are coupled in series; (e) in the transmit mode of operation, the first and the second transmit switch input ports are coupled to a first output terminal in the transmit module, and the first and the second transmit switch output ports are coupled to a second output terminal in the transmit module, so that the conductors are coupled in parallel to the first and the second output terminals in the transmit module.

In yet another aspect, the present invention provides, a transceiver operable in a receive mode for receiving signals and operable in a transmit mode for transmitting signals, the transceiver comprises: (a) a receive module; (b) a transmit module; (c) a controller for selectively enabling the receive module to receive incoming radio signals to the transceiver, and for selectively enabling the transmit module to transmit outgoing signals from the transceiver; (d) an antenna coil, the antenna coil includes, (i) a plurality of conductors, each of the conductors having a first end and a second end; (ii) a switch mechanism for coupling the conductors in parallel for operation in the transmit mode, and the switch including an input port for connecting the first ends of the conductors to a first output terminal on the transmit module and second input port for connecting the second ends of the conductors to a second output terminal on the transmit module, the first and second output terminals forming an output port for the transmit module; (iii) a switch mechanism for coupling the conductors in series for operation in receive mode, and the switch including a first port for connecting the first end of one of the conductors to a first input terminal on the receive module and a second port for connecting the second end of another of the conductors to a second input terminal on the receive module, the first and second input terminals forming an input port for the receive module; (iv) a control mechanism for switching the switch mechanism between the receive mode and transmit mode of operation.

BRIEF DESCRIPTION OF THE DRAWINGS

Reference will now be made to the accompanying drawings which show, by way of example, a preferred embodiment of the present invention, and in which.

DETAILED DESCRIPTION OF THE PREFERRED EMBODIMENTS

Figure 1:
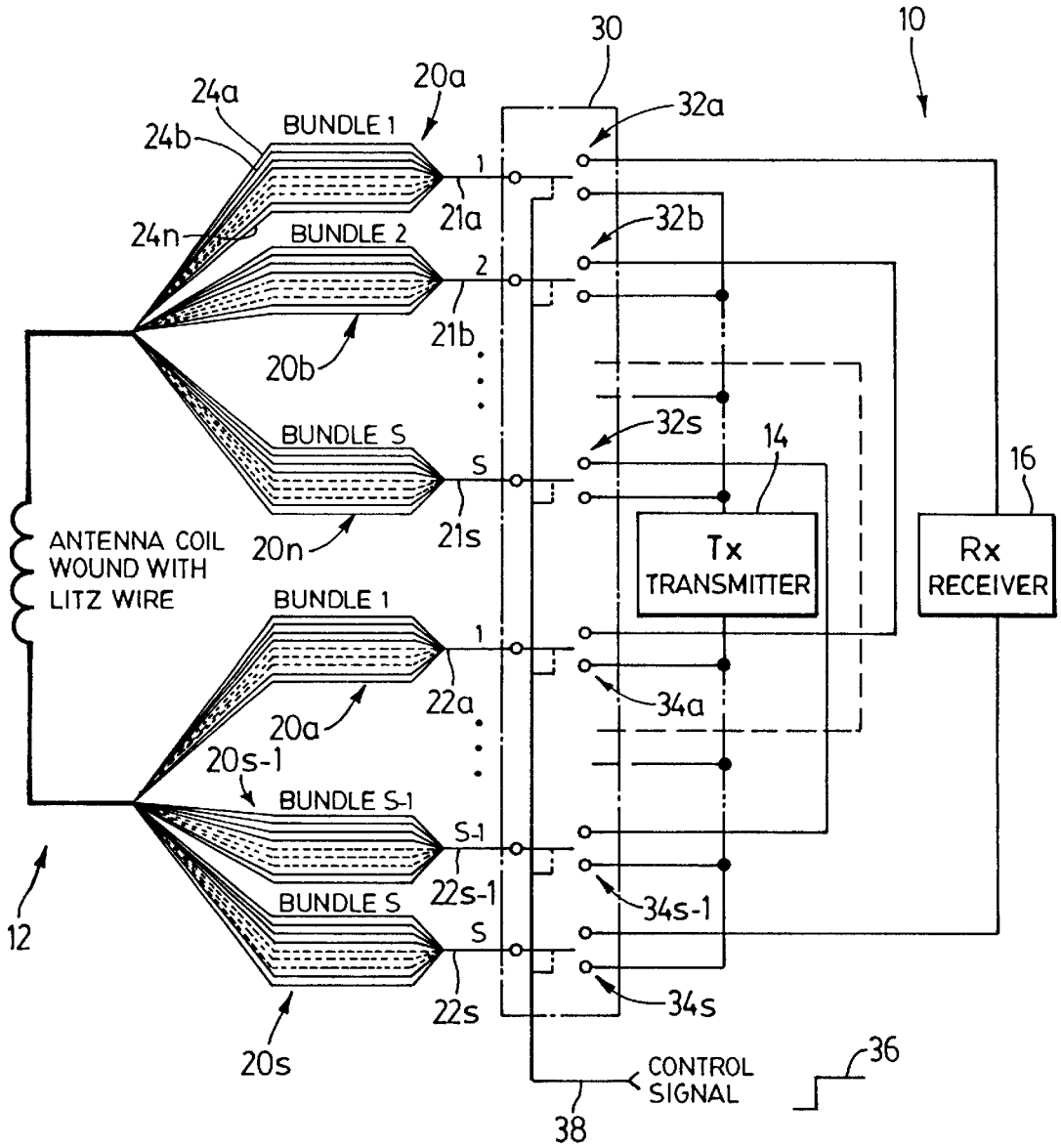
FIG. 1 shows in schematic form a transceiver and a switchable antenna according to the present invention.

Reference is first made to FIG. 1 which shows in schematic form a transceiver 10 and a switchable antenna coil 12 according to the present invention. As shown in FIG. 1, the transceiver 10 comprises a transmitter 14 and a receiver 16. In known fashion, the transmitter 14 and the receiver 16 are combined into a single unit in the transceiver 10 to permit both transmission and reception of signals. In the context of the present invention, the term signal means a signal that is transmitted via electromagnetic waves, for example radio signals, or a signal that is transmitted via a magnetic field. Accordingly, the transceiver 10 may be implemented for the transmission and reception of radio signals. Further implementation details for the transmitter 14 and the receiver 16 in the context of the transceiver 10 will be within the understanding of the those skilled in the art.

As shown in FIG. 1, the antenna 12 according to the present invention comprises a series of bundles 20, shown individually as 20*a*, 20*b*, . . . , 20*s*−1, 20*s*. Each bundle 20 has input end 21, shown individually as 21*a*,21*b*, . . . 21*s*−1, 21*s*, and an output end 22, shown individually as 22*a*, 22*b*, . . . 22*s*−1, 22*s*, in FIG. 1. Each bundle 20 comprises one or more strands of wire 24, shown individually as 24*a*, 24*b*, . . . 24*n*−1, 24*n*, for the first bundle 20*a*. In the preferred embodiment, the antenna coil 12 is conveniently implemented using known Litz-type wire. Litz-type wire comprises a series of bundles, with each bundle having one or more strands of wire.

As also shown in FIG. 1, the transceiver 10 includes a switching module 30 which couples the antenna coil 12 to the transmitter 14 and to the receiver 16. The switching module 30 switches the antenna coil 12 between the transmit and receive modes. The switching module 30 includes a switching element 32 for each of the input ends 21 of the bundles 20. The switching elements 32 are shown individually as 32*a*, 32*b*, . . . 32*s* in FIG. 1. Similarly, the switching module 30 includes a switching element 34 for each of the output ends 22 of the bundles. The switching elements 34 are shown individually as 34*a*, . . . 34*s*−1, 34*s* in FIG. 1. Each pair of switching elements 32, 34 couples the associated bundle 20 in the antenna coil 12 to the transceiver 10 and switches the bundle 20 between the transmitter 14 and the receiver 16, in the transmit and receive modes of operation respectively as will be described in more detail below. The switching elements 32, 34 are switched between the transmit and receive modes through a switching control signal 36 which is applied at a control port 38. The control signal 36 to switch between transmit and receive modes may be generated in any number of ways in the transceiver 10 as will be familiar to one skilled in the art.

Figure 2:
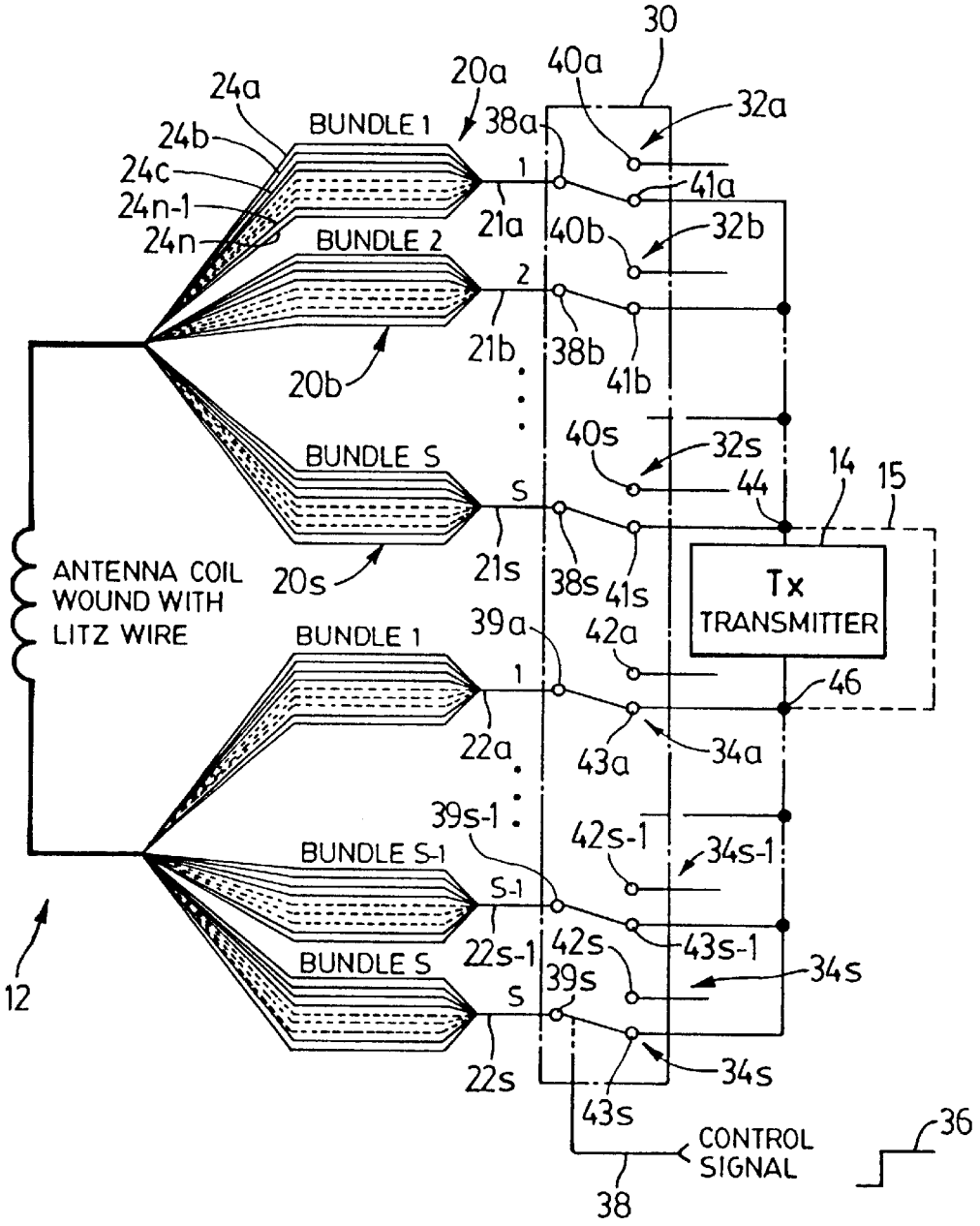
FIG. 2 shows in schematic form the switchable antenna according to the present invention configured for transmit mode.

Reference is next made to FIG. 2, which shows the configuration of the antenna coil 12 in the transmit mode of operation, ie. the transceiver 10 uses the antenna coil 12 to transmit signals. In transmit mode, the bundles 20 in the antenna 12 are connected in parallel to a transmit output port 15 on the transmitter 14 through the switching module 30. The input ends 21 of the bundles 20 are connected to respective input switching elements 32. Each of the input switching elements 32 includes an input port 38, a first output port 40, and a second output port 41. In FIG. 2, the input ports 38, the first output ports 40 and the second output ports 41, are shown individually as 38*a*, 38*b*, . . . 38*s*, 40*a*, 40*b*, . . . 40*s*, and 41*a*, 41*b*, . . . 41*s*, respectively. Similarly, the output ends 22 of the bundles 20 are connected to respective switching elements 34 in the switching module 30. As shown, each of the output switching elements 34 includes an input port 39, a first output port 42, and a second output port 43. In FIG. 2, the input ports 39, the first output ports 42 and the second output ports 43, are shown individually as 39*a*, 39*b*, . . . 39*s*, 42*a*, 42*b*, . . . 42*s*, and 43*a*, 43*b*, . . . 43*s*, respectively. In transmit mode, the switching elements 32 are switched so that the input ends 21 of the bundles 20 are coupled together, and similarly, the switching elements 34 are switched so that the output ends 22 of the bundles the bundles 20 are coupled together. i.e. the input end 21 of each of the bundles 20 is connected together at a first terminal or node 44 through the second output port 41 of the input switching element 32, and the output end 22 of each of the bundles 20 is connected together at a second terminal or node 46 through the second output port 43 of the output switching elements 34. (The terminals 44 and 46 form the output port 15 for the transmit module 14.) This switched arrangement results in the bundles 20 being effectively connected in parallel. The transmitter 14 is coupled to connected input ends 21 of the bundles 20 at the node 44 and the connected output ends 22 of the bundles 20 at the node 46. The resulting parallel configuration of the bundles 20 in the antenna coil 12 gives the transmitter 14 an increased number of wire strands 24 per turn arranged as Litz-type wire. Advantageously, the increased number of wire strands 24 per turn arranged as Litz-type wire, reduces the AC resistance, and therefore power loss resulting in efficient operation of the antenna coil 12.

Figure 3:
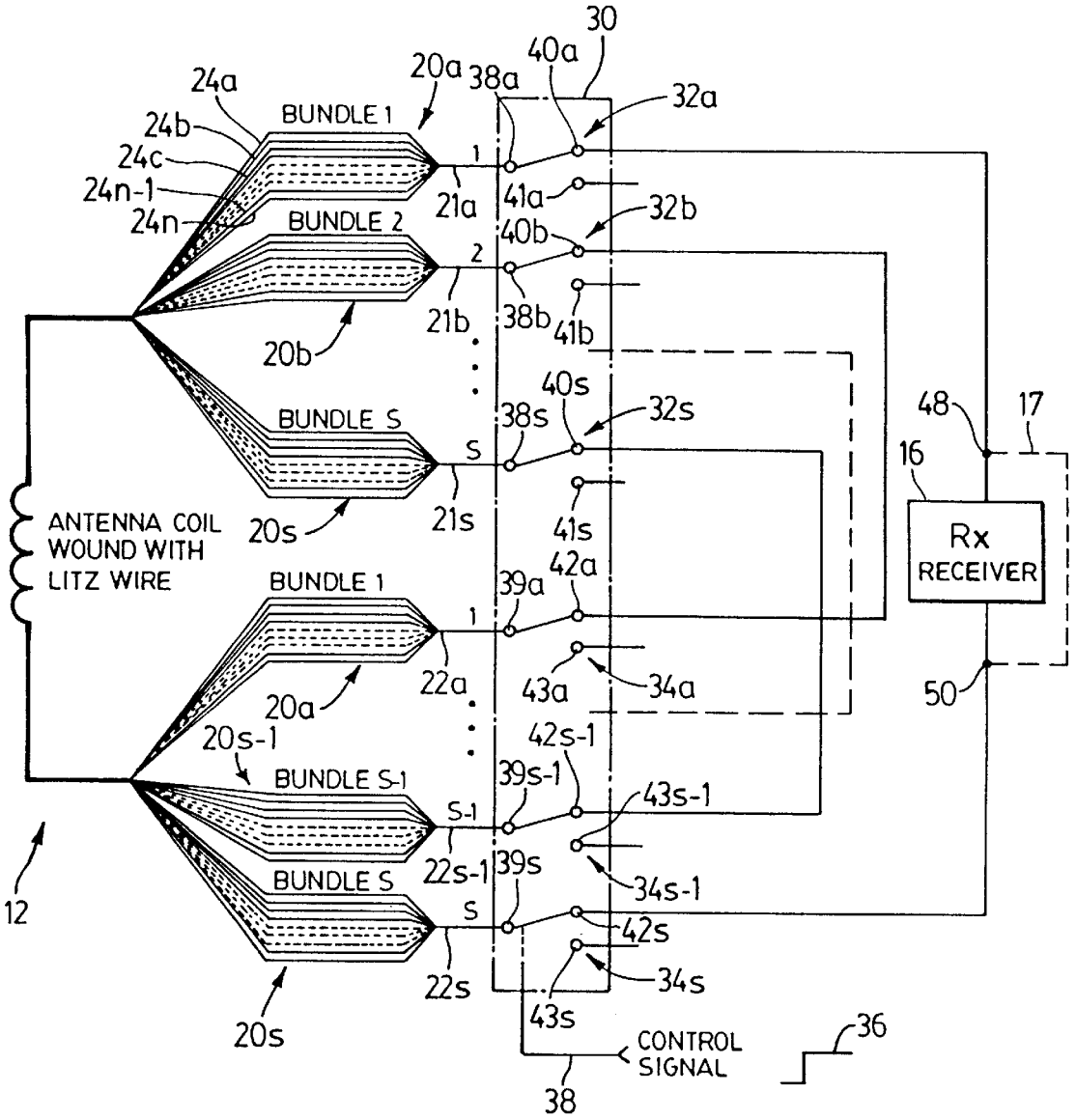
FIG. 3 shows in schematic form the switchable antenna according to the present invention configured for receive mode.

Reference is next made to FIG. 3, which shows the configuration of the antenna coil 12 in the receive mode of operation, i.e. the transceiver utilizes the antenna coil 12 for receiving signals. As shown in FIG. 3, in receive mode the bundles 20 are connected end-to-end in series. This series arrangement of the bundles 20 effectively increases the number of turns on the antenna by the number of bundles, i.e. S. As shown in FIG. 3, the input end 21*a* of the first bundle 20*a* is coupled to the radio receiver 16 in the transceiver 10 through the first output port 40*a* of the switching element 32*a* at a first input terminal 48, and the output end 22*s* of the last bundle 22*s* is coupled to a second input terminal 50 on the receiver 16 through the first output port 42*s* of the last switching element 34*s*. The first 48 and second 50 terminals form an input terminal 17 for the receiver module 16 for receiving the signals coupled by the antenna coil 12. The remaining bundles 20 are connected end-to-end in series. As shown, the input end 21*b* of the second bundle 20*b* is coupled to the output end 22*a* of the first bundle 20*a* through the switching elements 32*b* and 34*a*, and the input end 21*s* of the last bundle 20*s* is coupled to the output end 22*s*−1 of the second last bundle 20*s*−1 through the switching elements 32*s* and 34*s*−1. By coupling the bundles 20 in series, the effective number of turns of the antenna coil 12 is increased. The increased number of turns results in better sensitivity of the antenna coil 12 which produces a higher level output for a given magnetic field strength input signal. If each one of the bundles 20 comprises more than one strand 24, then the connection of the individual strands 24 in a bundle 20 further reduces AC resistance and power loss in the antenna coil 12 in receive mode. Advantageously, the antenna coil 12 operates more efficiently allowing a higher output signal level for a given magnetic field than a conventional antenna with equal turns of a single wire.

The performance of the antenna coil 12 according to the present invention is now described in the context of the following example.

In this example, the characteristics of the antenna coil 12 are compared to a conventional antenna transmit coil formed of 120 turns of solid wire with an AWG of #10 requiring 102 Watts of power to produce a drive current of approximately 10 A through the coil to yield 110 A-m$^2$. In receive mode, the 120 turns of wire yield the following parameters 2.87 mH, 59 Ohms, Q=91, and emf=0.019 mV at 1 pT and 3 kHz. As will now be described, the power requirement drops with an antenna coil 12 according to the present invention.

Next, an antenna coil 12 according to the present invention comprising a Litz-type wire with 120 turns and having 51 bundles 20 (i.e. s=51) is considered. Each bundle comprises a single wire strand 24 having a wire gauge (AWG) of #27. In transmit mode, the 51 bundles 20 (or strands 24) are coupled in parallel, and the current in each bundle 20 is approximately 196 mA (i.e. 10 A/51). Because the current magnitudes are not high, the switching elements 32, 34 (FIG. 1) may be implemented using small switches. In receive mode, the 51 bundles 20 are coupled in series end-to-end as described above and the effective number of turns of the coil is 6120 (i.e N=120×51) of AWG #27. On a first approximation, the 6120 turns yields the following characteristics: Inductance=7.5 H, DC resistance=1500 ohms, Q=98, emf=1 mV at 1 pT and 3 kHz. It until be appreciated that the AC resistance is not accounted for in this approximation, but would be considerable.

Next, the antenna coil 12 is considered with the 51 bundles 20 (of the 120 turns of Litz-type wire) being arranged into 10 bunches with 5 wire strands each (and one bunch having 6 wire strands). i.e. 51/5=10. The effective wire gauge (AWG) for each bundle of 5 strands is #20. Each switch 32, 34 (FIG. 1), in turn, must handle 10 A/10=1 A of current in transmit mode. In receive mode, the bundles 20 are coupled in series end-to-end resulting in an antenna coil 12 with 1200 turns (i.e. N=10×120), which yields the following characteristics: Inductance=289 mH, DC resistance=56 Ohms, Q=97, and EMF=0.2 mV at 1 pT and 3 kHz. Again AC resistance was not accounted for, but would be considerable.

It will be appreciated that for the antenna coil 12, the inductance goes up by a factor of s$^2$, the DC resistance also goes up by a factor s$^2$ (i.e. s times the resistance by s times the length), and the induced EMF goes up by a factor of s.

The following three experiments were conducted with an antenna formed as a single-layer 120 turn rectangular coil. In the first experiment, the antenna coil 12 is configured in receive mode according to the present invention with 51 bundles (i.e. s=51); in the second experiment, the antenna coil 12 is configured in receive mode with 10 bundles (i.e. s=10) according to the present invention; and in the third a conventional antenna comprising 120 turns of a single solid wire is utilized.

(1) Single-Layer Rectangular Antenna Coil (12) in Receive Mode 120 turns switched with 51 bundles (i.e. s=51)

Set centre frequency & modulation shift frequency (Hz):

f0:=3000·Hz

Set parameters for antenna coil 12:

N=6120 (i.e. total number of turns of wire on the coil)

AWG=27 (wire gauge)

w=7.125 in (width of rectangle)

h=20.375 in (height of rectangle)

I=13.5 in (length of rectangular coil)

Calculations:

area=0.093659 m$^2$ (i.e. w×h)

wirelength=8.54964.10$^3$ m (i.e. 2·(w+h)·N)

R=R_dc(AWG,wirelength,20)skin_effect(f0,wr(AWG)+Rdson then, R=1.44368·10$^{3°}$ Ω

L=Lslrc(w,h,I,2·wr(AWG),N) then, L=7.541465·10$^{6°}$ μH

Results for receive mode:

N=6.12 10$^3$ f0=3000° Hz

L=7541.465° mH

R=1443.68004° Ω Weu(wirelength,AWG)=7.760872° kg

Weu(wirelength,AWG)=17.109793° lb

Q(f0,L,R)=98.465902

R_dc(AWG,wirelength,20)=1443.64° Ω

Vemf(10$^{-12}$T,N,f0,area,Q(f0,L,R))=1.063869° mV (2) Single-Layer Rectangular Antenna Coil (12) with 10 Bundles 120 turns switched with 10 bundles (i.e. s=10)

Set centre frequency & modulation shift frequency (Hz):

f0=3000·Hz

Set parameters for antenna coil 12:

N=1200

AWG=20 w=7.125·in h=20.375·in

I=13.5·in

Calculations:

area=0.093559 m$^2$ (i.e. w×h)

wirelength=1.6764.10$^3$ m (i.e.2·(w+h)·N)

R=R_dc(AWG,wirelength,20)·skin_effect(f0,wr(AWG)+Rdson then, R=55.879111° Ω

L=Lslrc(w,h,I,2·wr(AWG),N) then, L=0.289H

Results for transmit mode:

N=1.2·10$^3$ f0=3000° Hz

L=289.039° mH

R=55.879111° Ω Weu(wirelength,AWG)=7.71418° kg

Weu(wirelength,AWG)=17.006856° lb

Q(f0,L,R)=97.500704

R_dc(AWG,wirelength,20)=55.839° Ω

(3) Conventional Single-Layer Rectangular Antenna Coil 120 turns single strand wire (i.e. s=1)

Set centre frequency & modulation shift frequency (Hz):

f0=3000·Hz

Set coil parameters for conventional antenna:

N=120

AWG=10 w=7.125·in h=20.375·in

I=13.5·in

Calculations:

area=0.093559 m$^2$ (i.e. w×h)

wirelength=167.64 m (i.e. 2·(w+h)·N)

R=R_dc(AWG,wirelength,20)·skin_effect (f0,wr(AWG)+Rdson then, R=0.589195° Ω

L=Lslrc(w,h,I,2·wr(AWG),N) then, L=2.867349·10$^{5°}$ μH

Set moment, or AT, or I:

$M=area \cdot I \cdot N$ $AT:=M \cdot area^{-3}$ $I=AT \cdot N^{-1}$ then, $M=110 \cdot A \cdot m^2$ $AT=1.174472 \cdot 10^3 A$ $I=9.787269$ A Results for conventional antenna:

N=120 f0=3000° Hz Δf=100° Hz Vbat=100° V

I=9.787° A Vcoil(f2,L,I)=537.801° V L=2.867° mH $AT=1.174472 \cdot 10^{3}$° A Vcoil(f2,L,I)$\cdot\sqrt{2}$=760.566° V $M=110 \cdot A \cdot m^2$ R=0.589195° Ω Weu(wirelength,AWG)=7.840801° kg P(I,R)=56.44° W Weu(wirelength,AWG)=17.286008° lb Q(f0,L,R)=91.732399

R_dc(AWG,wirelength,20)=0.549° Ω

Vemf($10^{-12}$·T,N,F0,area,Q(f0,L,R))=0.019434° mV

The parallel configuration of the bundles 20 (and strands 24) in transmit mode (FIG. 2) yields a low DC and AC resistance. A reasonable number of turns gives a voltage that is low enough to be dealt with conveniently. It will be understand that because there are numerous strands 24 of wire, the current in each strand 24 is 1/s times the total current, where s is the number of strands (FIG. 1). Advantageously, the small amount of current per strand 24 allows small, low current devices to be used for the switches 32, 34 in the switching module 30, while at the same time still providing for a very large transmit current. Relays or even transistors or cross-point switches may be utilized for the switches 32 and 34. It is further noted that the resistance of each switch 32, 34 is in parallel so that the total resistance of the switches 32 and 34 is given by $R_{total}=R_{switch}/s$. Where s is large, the resistance becomes insignificant.

For operation in receive mode, the number of turns in the antenna coil is effectively increased by s. This increase in the number of turns increases the inductance for the antenna coil 12. Alternatively, several strands 24 may be switched together (instead of single strands). This configuration has the effect of lowering the AC and DC resistance, but the inductance of the antenna coil 12 is also lowered.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein

What is claimed is:

1. An antenna coil for a transceiver having a receiver module for receiving signals and a transmitter module for transmitting signals, said antenna coil comprising:

(a) a plurality of conductors, each of said conductors having a first end and a second end;

(b) a switch mechanism for coupling said conductors in parallel for operation in transmit mode, and said switch mechanism including an input port for connecting said first ends of said conductors to a first output terminal on the transmit module and second input port for connecting said second ends of said conductors to a second output terminal on the transmit module, said first and second output terminals forming an output port for the transmit module;

(c) said switch mechanism for coupling said conductors in series for operation in receive mode, and said switch mechanism including a first port for connecting the first end of one of said conductors to a first input terminal on the receive module and a second port for connecting the second end of another of said conductors to a second input terminal on the receive module, said first and second input terminals forming an input port for the receive module;

(d) a control mechanism for switching said switch mechanism between the receive mode and transmit mode of operation.

2. The antenna coil as claimed in claim 1, wherein each of said conductors comprises a plurality of wire strands.

3. The antenna coil as claimed in claim 2, wherein said wire strands comprise thin diameter wire with a high average wire gauge.

4. The antenna coil as claimed in claim 3, wherein the antenna coil is formed from Litz-type wire.

5. An antenna coil for a transceiver, said transceiver being operable in a receive mode and a transmit mode, and said transceiver having a receiver module for receiving signals in said receive mode and a transmitter module for transmitting signals in said transmit mode, said antenna coil comprising:

(a) at least two conductors, each of said conductors having a first end and a second end;

(b) a switching module having a plurality of first switch inputs, a plurality of second switch inputs, each of said first switch inputs being coupled to one of said first ends of each of said conductors, and each of said second switch inputs being coupled to one of said second ends of each of said conductors;

(c) said switching module including a plurality of receive switch output ports and a plurality of receive switch input ports, and said switching module including a plurality of transmit switch input ports and a plurality of transmit switch output ports;

(d) in said receive mode of operation. said first receive switch output being coupled to a first input terminal in the receiver module and said last receive switch output being coupled to a second input terminal in the receiver module, said second receive switch output port being coupled to said first receive switch input port, so that said conductors are coupled in series;

(e) in said transmit mode of operation, said first and said second transmit switch input ports being coupled to a first output terminal in the transmit module, and said first and said second transmit switch output ports being coupled to a second output terminal in the transmit module, so that said conductors are coupled in parallel to said first and said second output terminals in the transmit module.

6. The antenna coil as claimed in claim 5, wherein each of said conductors comprises a plurality of wire strands.

7. The antenna coil as claimed in claim 5, wherein said wire strands comprise thin diameter wire with a high average wire gauge.

8. The antenna coil as claimed in claim 7, wherein the antenna coil is formed from Litz-type wire.

9. A transceiver operable in a receive mode for receiving signals and operable in a transmit mode for transmitting signals, said transceiver comprising:

(a) a receive module;

(b) a transmit module;

(c) a controller for selectively enabling said receive module to receive incoming signals to the said transceiver, and for selectively enabling said transmit module to transmit outgoing signals from said transceiver;

(d) an antenna coil, said antenna coil comprising:

(i) a plurality of conductors, each of said conductors having a first end and a second end, (ii) a switch mechanism for coupling said conductors in parallel for operation in the transmit mode, and said switch mechanism including an input port for connecting said first ends of said conductors to a first output terminal on the transmit module and second input port for connecting said second ends of said conductors to a second output terminal on the transmit module, said first and second output terminals forming an output port for the transmit module;

(iii) said switch mechanism for coupling said conductors in series for operation in receive mode, and said switch mechanism including a first port for connecting the first end of one of said conductors to a first input terminal on the receive module and a second port for connecting the second end of another of said conductors to a second input terminal on the receive module, said first and second input terminals forming an input port for the receive module;

(iv) a control mechanism for switching said switch mechanism between the receive mode and transmit mode of operation.

10. The antenna coil as claimed in claim 9, wherein each of said conductors comprises a plurality of wire strands.

11. The antenna coil as claimed in claim 10, wherein said wire strands comprise thin diameter wire with a high average wire gauge.

12. The antenna coil as claimed in claim 11 wherein the antenna coil is formed from Litz-type wire.

* * * * *